US007414185B2

(12) United States Patent
Hsieh

(10) Patent No.: US 7,414,185 B2
(45) Date of Patent: Aug. 19, 2008

(54) PORTABLE TROMBONE STAND

(75) Inventor: Wu-Hong Hsieh, Lu Chou (TW)

(73) Assignee: K.H.S. Musical Instrument Co., Ltd. (TW)

( * ) Notice: Subject to any disclaimer, the term of this patent is extended or adjusted under 35 U.S.C. 154(b) by 0 days.

(21) Appl. No.: 11/654,522

(22) Filed: Jan. 18, 2007

(65) Prior Publication Data

US 2008/0173153 A1 Jul. 24, 2008

(51) Int. Cl.
*G10D 9/00* (2006.01)

(52) U.S. Cl. ..... 84/385 A; 248/166

(58) Field of Classification Search ..... 84/385 A, 84/387 A; 248/166, 185.1; D17/13
See application file for complete search history.

(56) References Cited

U.S. PATENT DOCUMENTS 4,407,182 A * 10/1983 Biasini ..... 84/453
4,529,865 A * 7/1985 Oakes, Jr. ..... 219/201
5,833,199 A * 11/1998 Benting et al. ..... 248/441.1
6,007,032 A * 12/1999 Kuo ..... 248/185.1
7,317,156 B2 * 1/2008 Hsieh ..... 84/387 A

* cited by examiner

*Primary Examiner*—Lincoln Donovan
*Assistant Examiner*—Jianchun Qin
(74) *Attorney, Agent, or Firm*—Hershkovitz & Associates, LLC; Abe Hershkovitz

(57) ABSTRACT

A portable trombone stand has a base and a post. The base can be placed over a plane stably and has multiple legs radially mounted around the base. Each leg has a pivoting end pivotally mounted in the base. The post is perpendicularly mounted securely on the base and has an instrument bracket mounted slidably on the post. The instrument bracket can be fastened on the post via a fastener and is able to be embedded in a cylindrical bore of a trombone to hold the trombone in position. Eventually, the portable trombone stand can be put into a cylindrical bore of a trombone, then put the portable trombone stand and the trombone into a case altogether. In this manner, the trombonist can conveniently carry the box to move around.

5 Claims, 8 Drawing Sheets

PORTABLE TROMBONE STAND

BACKGROUND OF THE INVENTION

1. Field of the Invention

The present invention relates to a stand, and more particularly to a portable trombone stand that is convenient to carry.

2. Description of Related Art

The trombone is a musical wind instrument, has a cylindrical metal tube expanding into a bell and bent twice in a U shape and is usually equipped with a slide that changes the length of the tube to change the instrument's pitche.

Trombone stands temporarily hold a trombone and keep the trombone from collapsing, and a conventional trombone stand has a base and a post. The base stands stably on virtually any planar surface. The post is mounted securely in the base, is stationary relative to the base and has a stationary instrument bracket on which the bell of the cylindrical metal tube is mounted to hold the trombone in position.

Although a conventional trombone stand supports the trombone, the conventional trombone stand is inconvenient to carry. Trombonists have to carry a trombone case in one hand and the conventional trombone stand in the other hand. In this manner, trombonists become tired and have trouble moving around.

To overcome the shortcomings, the present invention provides a portable trombone stand to obviate or mitigate the aforementioned problems.

SUMMARY OF THE INVENTION

The main objective of the present invention is to provide a portable trombone stand that is foldable and is convenient to carry.

To achieve the objective, the portable trombone stand in accordance with the present invention comprises a base, a post and an instrument bracket. The base can stand stably on a planar surface and has multiple legs radially mounted around the base. Each leg has a proximal end mounted pivotally in the base. The post is mounted securely on and protrudes perpendicularly up from the base. The instrument bracket is mounted slidably on the post, can be fastened securely to the post and is able to hold the trombone in position.

In preparation for carrying the portable trombone stand, the instrument bracket slides toward the base and the legs of the base rotate toward the post to displace a small volume and moreover, to take on a conical shape that corresponds to the bell of the cylindrical metal tube of the trombone. Consequently, the portable trombone stand can be inserted into and carried in the bell of the cylindrical metal tube of the trombone, and the portable trombone stand and the trombone can be carried in a trombone case altogether. In this manner, a trombonist can conveniently carry the case.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
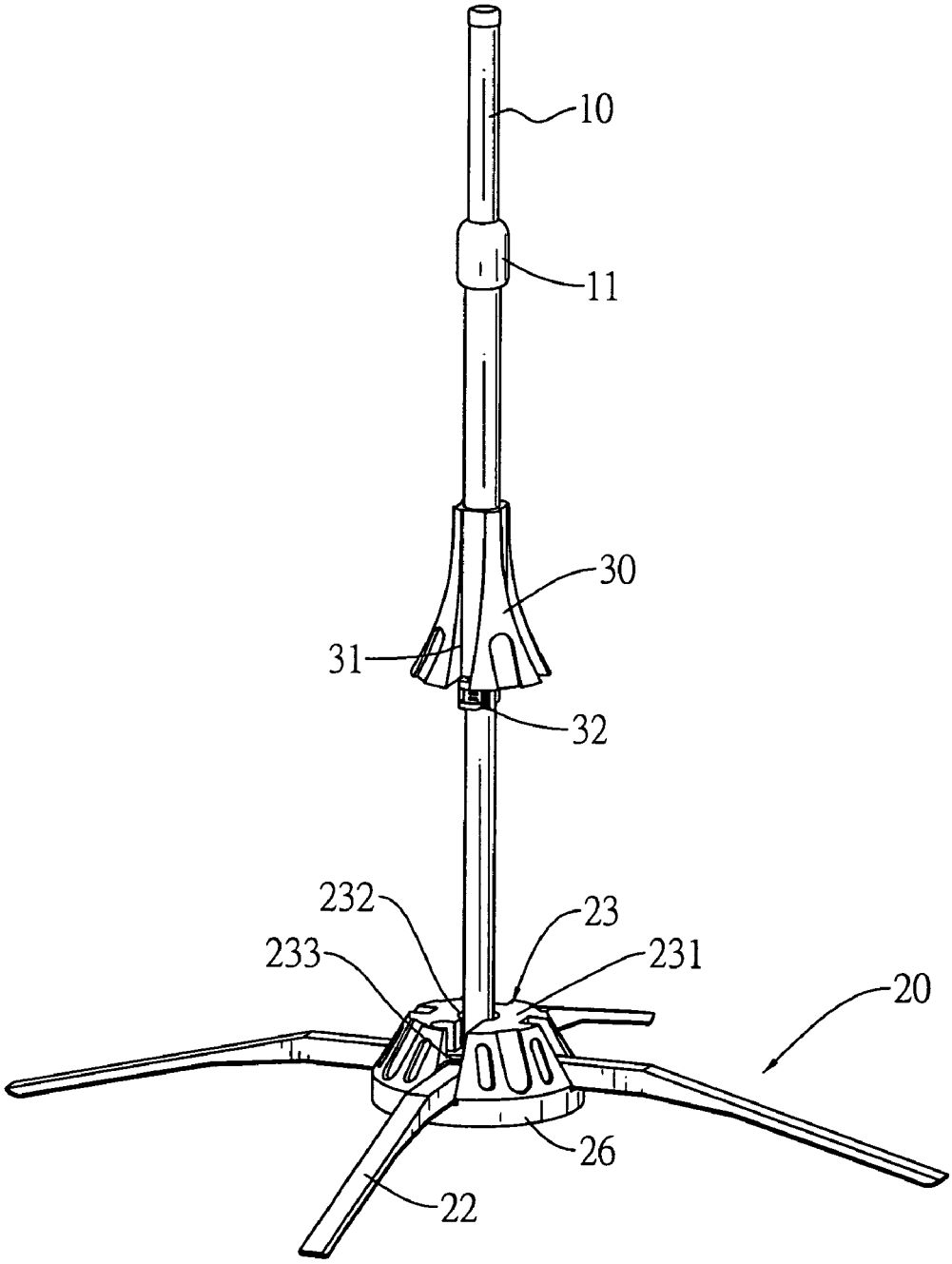
FIG. 1 is a perspective view of a portable trombone stand in accordance with the present invention.
Figure 2:
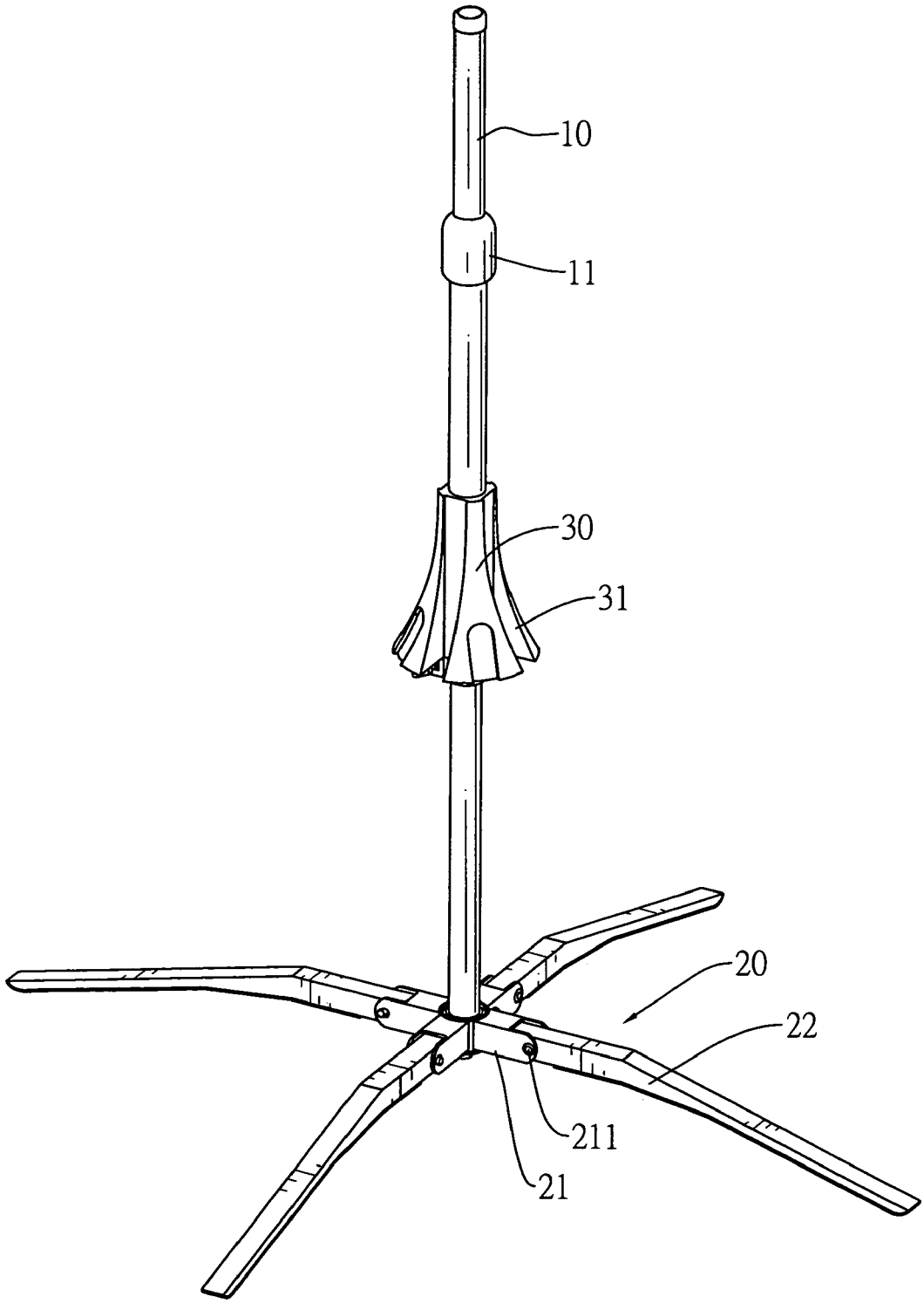
FIG. 2 is a partial perspective view of the portable trombone stand in FIG. 1.
Figure 3:
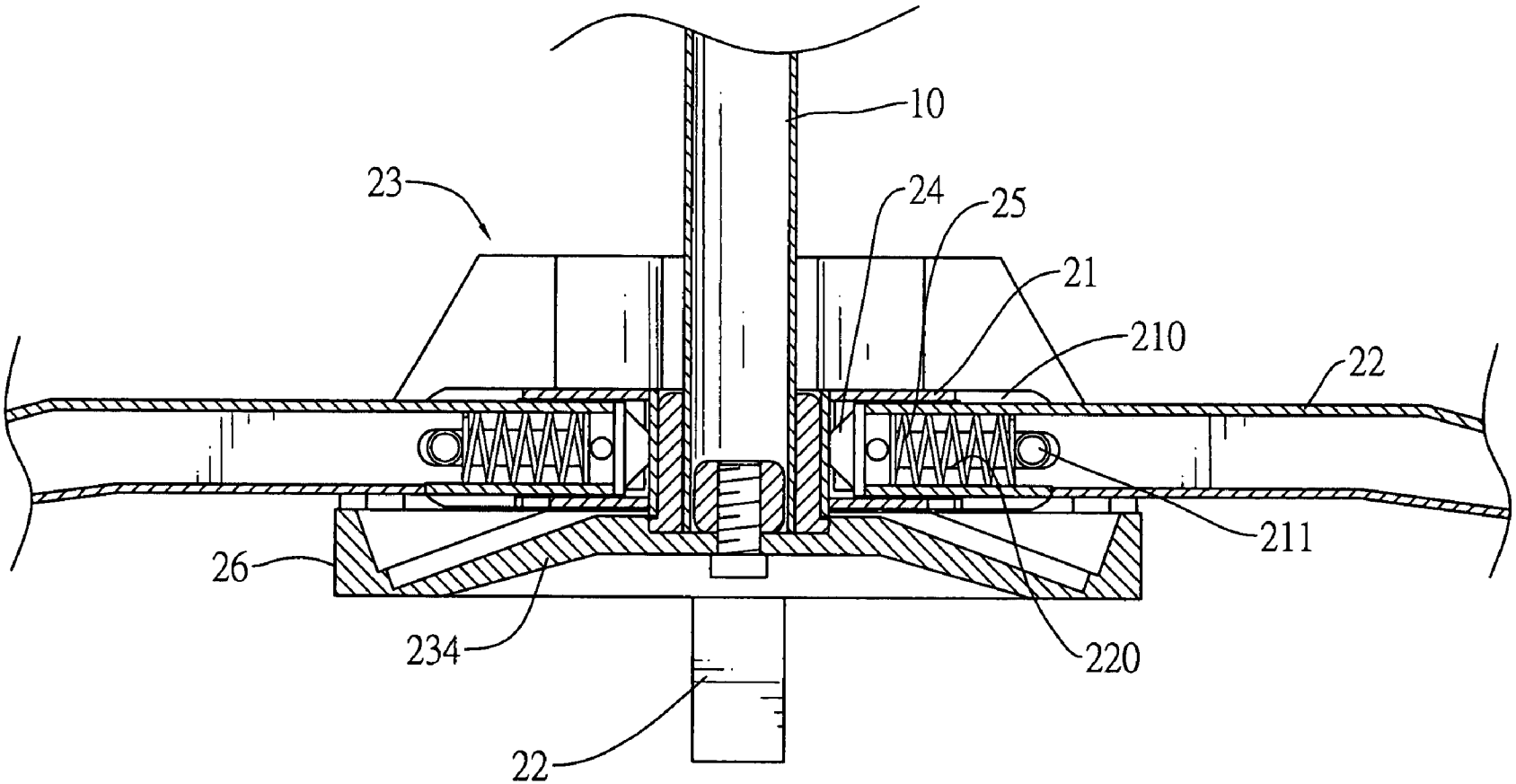
FIG. 3 is an enlarged side view in partial section of a base of a portable trombone stand in FIG. 1.

With reference to FIGS. 1, 2 and 3, the portable trombone stand in accordance with the present invention comprises a base (20), a post (10) and an instrument bracket (30).

The base (20) can expand and stand on a planar surface, can collapse and be mounted in a bell of a cylindrical metal tube of a trombone and has a pedestal bracket (23), multiple hinges (21) and multiple legs (22).

The pedestal bracket (23) is a truncated cone and has a top surface (231), a bottom, a central bore (232), multiple mounting slots (233) and a bottom cap (234). The central bore (232) is formed in the pedestal bracket (23) through the top surface (231) and communicates with the bottom of the pedestal bracket (23). The mounting slots (233) are formed radially in the pedestal bracket (23) and communicate with the central bore (232) at the bottom of the pedestal bracket (23).

The hinges (21) are respectively mounted securely in the mounting slots (233) of the pedestal bracket (23). Each hinge (21) is formed from square tubes and has a proximal end, a distal end, two sides, two wings (210) and a pin (211). The wings (210) are formed respectively on and protrude respectively from the sides of the hinge (21) at the distal end. The pin (211) mounted securely between the wings (210).

The bottom cap (234) is mounted securely on the bottom of the pedestal bracket (23), holds the hinges (21) securely in the pedestal bracket (23) and has a top surface, multiple retaining slots and an optional central hole. The retaining slots are formed in the top surface of the bottom cap (234) and correspond to and extend down at an angle respectively from the hinges (21).

Figure 4:
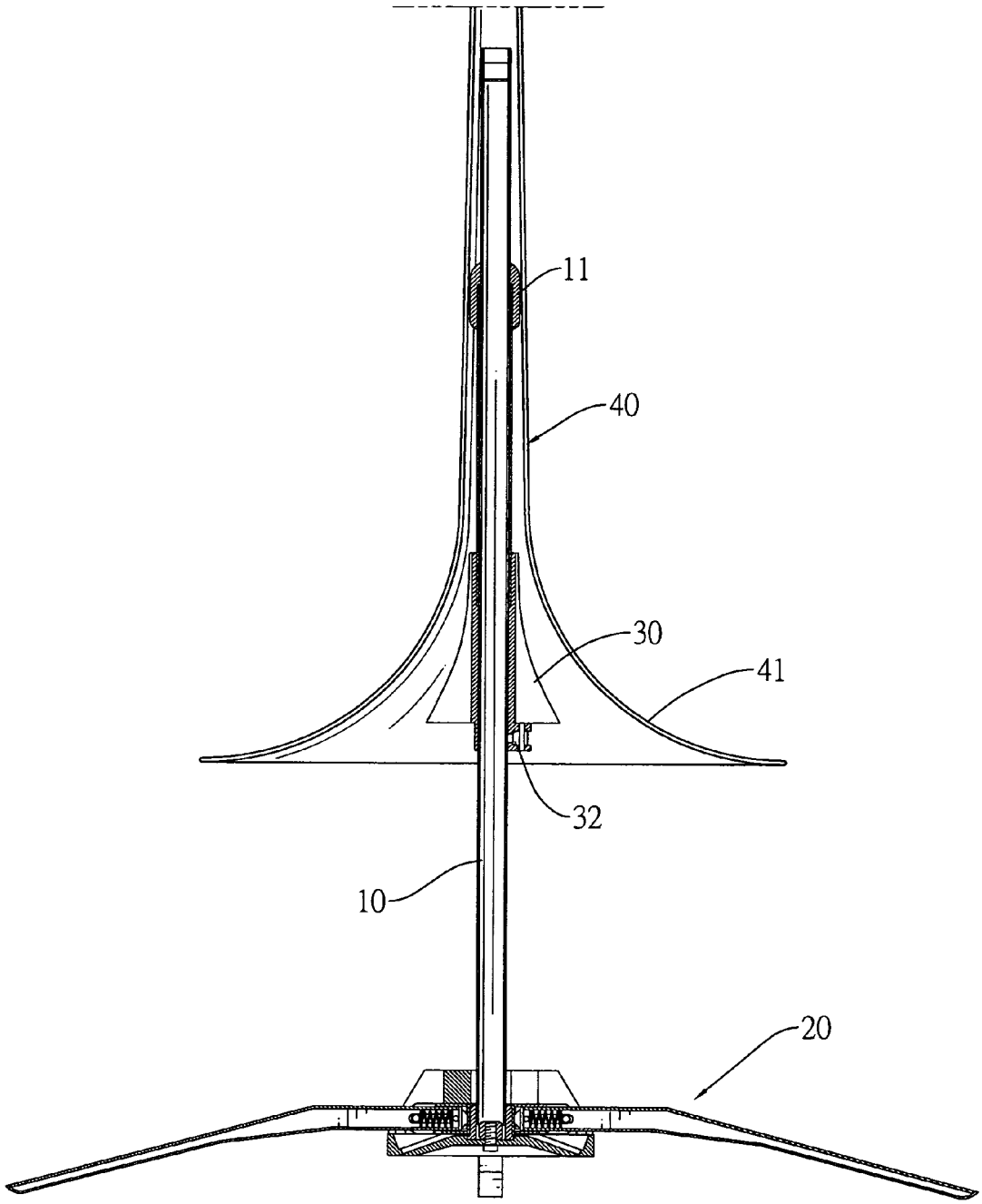
FIG. 4 is a side view in partial section of the portable trombone stand in FIG. 1, showing a cylindrical bore of a trombone held on the portable trombone stand.
Figure 5:
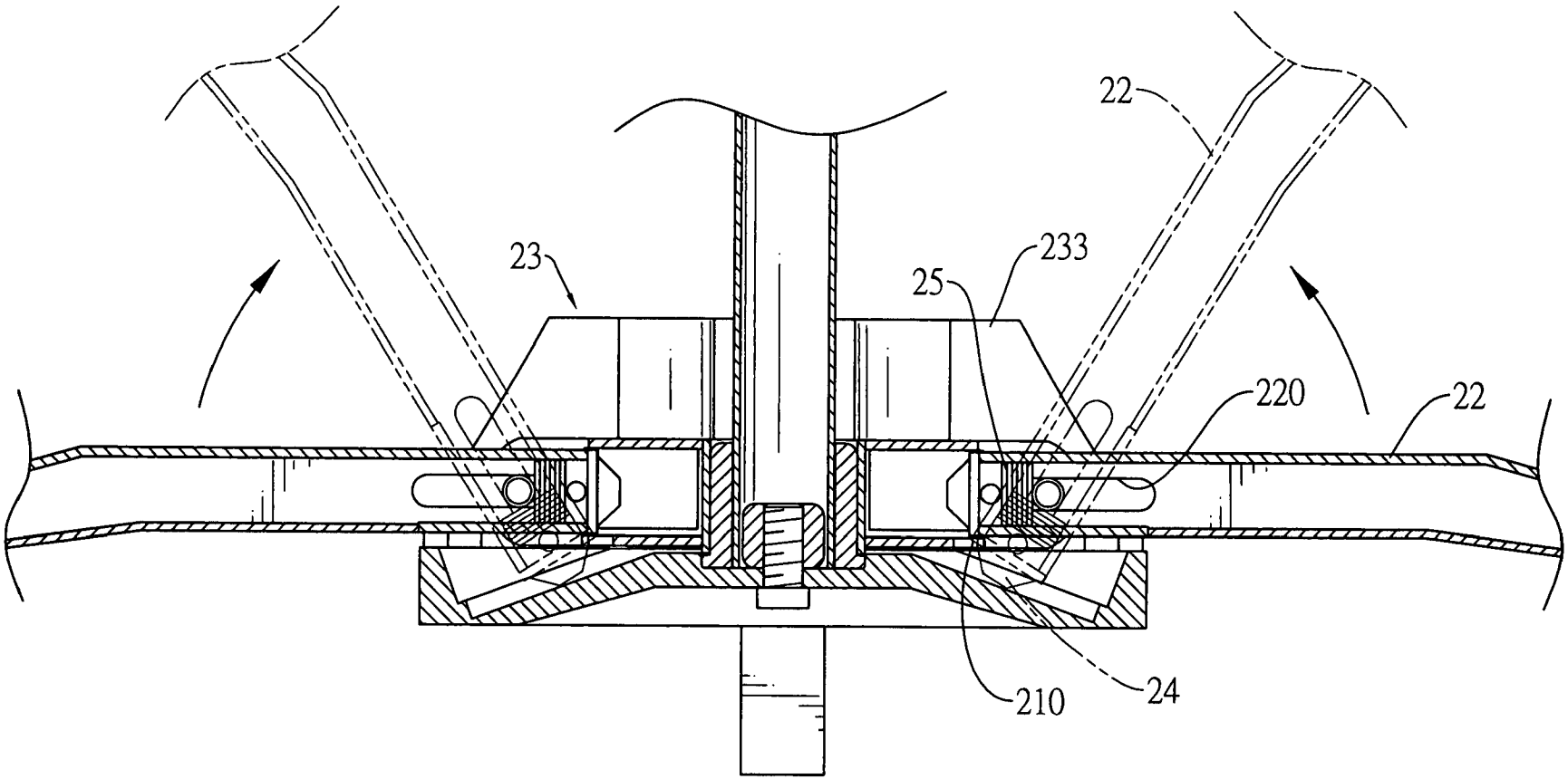
FIG. 5 is an operational side view in partial section of the portable trombone stand in FIG. 1 showing the legs of the base rotating.
Figure 6:
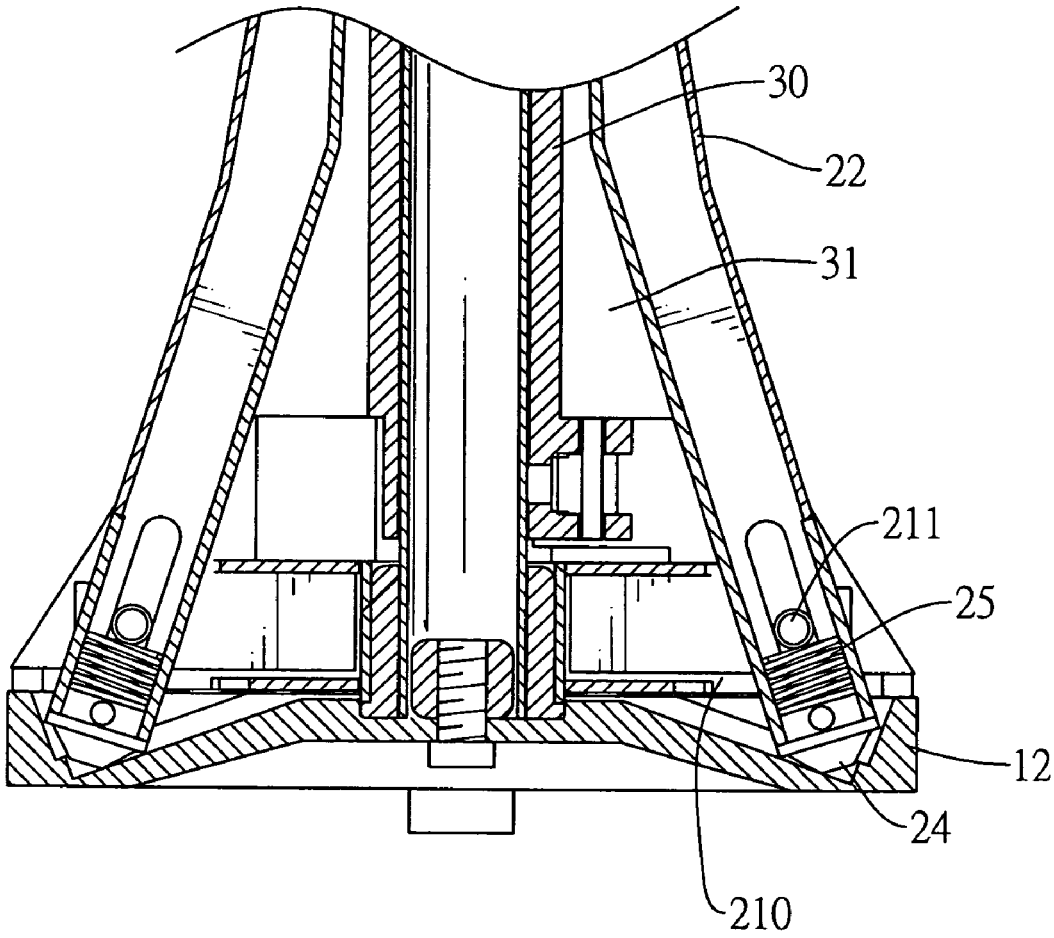
FIG. 6 is an operational side view in partial section of the portable trombone stand in FIG. 1 showing the legs of the base folded.
Figure 7:
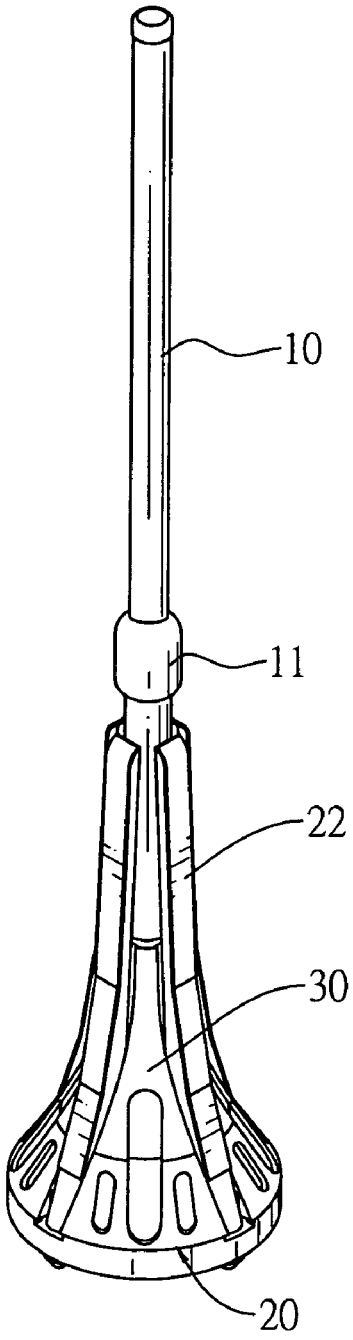
FIG. 7 is a perspective view of the portable trombone stand in FIG. 1 showing the legs of the base folded.
Figure 8:
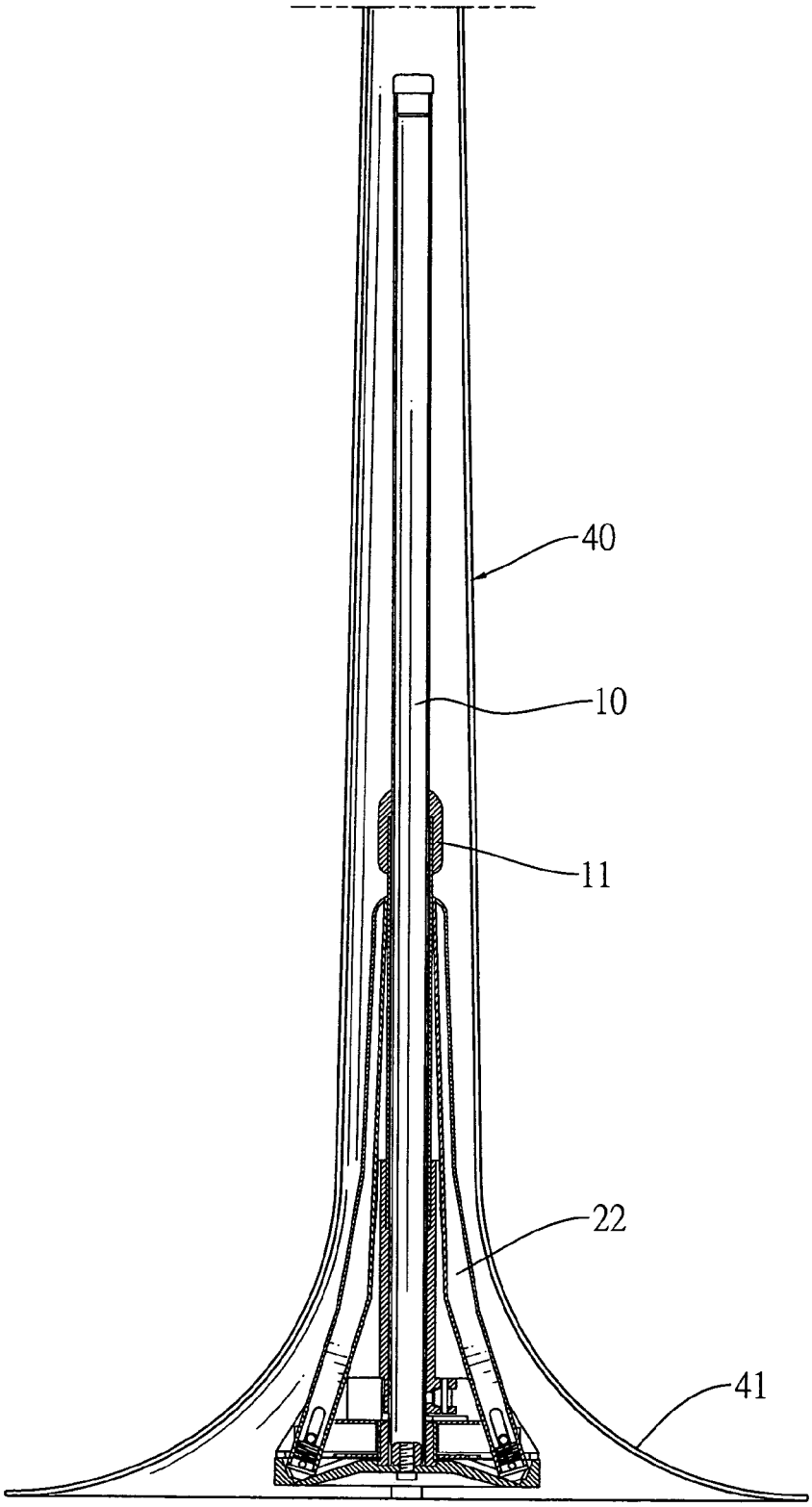
FIG. 8 is a side view in partial section of the portable trombone stand in FIG. 1, showing the portable trombone stand put in the cylindrical bore of the trombone.

With further reference to FIG. 4, the legs (22) are hollow and slightly curved, correspond respectively to and are pivotally mounted respectively in the hinges (21) and protrude respectively from the mounting slots (233) in the pedestal bracket (23). Each leg (22) has a proximal end, a distal end, an end cap (24), two longitudinal slots (220) and a resilient element (25). The proximal end is mounted detachably and pivotally in the corresponding hinge (21). The end cap (24) is mounted securely in the proximal end of the leg (22) and slidably in the corresponding hinge (21). The longitudinal slots (220) are formed diametrically opposite to each other near the proximal end of the leg (22) and are mounted slidably on the corresponding pin (211). The resilient element (25) is mounted between the end cap (24) and the pin (211) and presses the end cap (24) toward the center of the hinge (21) to hold the leg (22) securely in the hinge (21). The proximal end of the leg (22) is detached from the hinge (21) by pulling the leg (22) and compressing the resilient element (25) so the leg (22) can be folded up and the end cap (24) can be held in the retaining slot in the bottom cap (234).

The post (10) may be solid or tubular, is mounted securely in the central bore (232) in the pedestal bracket (23) and has an upper end, a bottom end, an optional plug, an optional bolt and an optional annular cushion (11). When the post (10) is solid, the bottom end may have a coaxial threaded hole. When the post (10) is tubular, the plug is mounted securely in the bottom end of the post (10) and has a coaxial threaded hole. The bolt is mounted through the central hole in the bottom cap (234) and screws into the threaded hole in the bottom end 41 the solid post (10) or the threaded hole in the plug in the bottom end of the tubular post (10). The annular cushion (1) is mounted movably around the post (10) near the upper end and can be moved to different positions along the post (10).

With further reference to FIGS. 5, 6, 7 and 8, the instrument bracket (30) is conical, is mounted slidably on the post (10), allows the legs (22) to fold against the post (10) when the legs are pivoted up and has a bottom, a side surface, multiple optional storage slots (31) and a fastener (32). The storage slots (31) are formed longitudinally in the side surface, correspond respectively to the legs (22) of the base (20) and allow the legs (22) to fold against the post (10) when the legs (22) are pivoted up so the post (10) and the legs (22) can be inserted into a bell (41) in a cylindrical tube of a trombone (40). The fastener (32) is mounted rotatably and eccentrically on the bottom of the instrument bracket (30) adjacent to the post (10) and has an outer edge. Turning the fastener (32) causes the outer edge of the fastener (32) to press against the post (10) and hold the instrument bracket (30) in position.

The portable trombone stand as described allows the portable trombone stand to be stored and carried in a conventional trombone case. In this manner, a trombonist can conveniently carry the portable trombone stand.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A portable trombone stand comprising:

a base having a pedestal bracket having a top surface;

a bottom;

a central bore; and multiple mounting slots being formed radially in the pedestal bracket; and multiple hinges being securely mounted respectively in the mounting slots in the pedestal bracket, and each hinge has a proximal end;

a distal end;

two sides;

two wings being formed respectively on and protruding respectively from the sides of the hinge at the distal end; and a pin mounted securely between the wings; and multiple legs corresponding respectively to and being pivotally mounted respectively in the mounting slots in the pedestal bracket, each leg having a proximal end;

a distal end;

an end cap being mounted securely in the proximal end of the leg and slidably in the corresponding hinge;

two longitudinal slots being formed diametrically opposite to each other near the proximal end of the leg and being mounted slidably on the pin of the corresponding hinge; and a resilient element being mounted between the end cap and the pin and pressing the end cap toward a center of the corresponding hinge;

a post being mounted securely in the central bore in the pedestal bracket and having an upper end; and a bottom end mounted securely in the central bore of the pedestal bracket; and an instrument bracket being mounted slidably on the post and having a bottom;

a side surface;

multiple storage slots being formed longitudinally in the side surface and corresponding respectively to the legs of the base to allow the legs to be folded against the post; and a fastener being mounted rotatably and eccentrically on the bottom of the instrument bracket adjacent to the post and having an outer edge.

2. The portable trombone stand as claimed in claim 1, wherein the base is a truncated cone; and the instrument bracket is a cone.

3. The portable trombone stand as claimed in claim 1, wherein each leg of the base is hollow and slightly curved.

4. The portable trombone stand as claimed in claim 1 further has an annular cushion being mounted movably around the post near the upper end.

5. The portable trombone stand as claimed in claim 1, wherein the post is hollow and further has a plug being mounted securely in the bottom end of the post and having a coaxial threaded hole; and a bolt is mounted through the pedestal bracket and screws into the threaded hole in the plug in the bottom end of the tubular post.

* * * * *